US008835815B2

(12) United States Patent
Kasai

(10) Patent No.: US 8,835,815 B2
(45) Date of Patent: Sep. 16, 2014

(54) HEATER CONTROL DEVICE, IMAGE FORMING APPARATUS, AND HEATER CONTROLLING METHOD

(75) Inventor: Takuma Kasai, Kangawa (JP)

(73) Assignee: Ricoh Company, Limited, Tokyo (JP)

( * ) Notice: Subject to any disclaimer, the term of this patent is extended or adjusted under 35 U.S.C. 154(b) by 599 days.

(21) Appl. No.: 13/153,980

(22) Filed: Jun. 6, 2011

(65) Prior Publication Data

US 2011/0303648 A1 Dec. 15, 2011

(30) Foreign Application Priority Data

Jun. 9, 2010 (JP) ..... 2010-132125

(51) Int. Cl.
*H05B 1/02* (2006.01)
*G03G 15/20* (2006.01)

(52) U.S. Cl.
CPC ..... *H05B 1/0241* (2013.01); *G03G 15/2007* (2013.01)
USPC ..... 219/502; 219/497; 219/492; 219/216; 399/69; 399/70

(58) Field of Classification Search
CPC ..... H05B 1/02; H05B 1/0241; G03G 15/2007
USPC ..... 219/492, 497, 501, 506, 483–487, 216; 399/67, 69
See application file for complete search history.

(56) References Cited

U.S. PATENT DOCUMENTS

| | | | | |
|---|---|---|---|---|
| 4,334,147 | A * | 6/1982 | Payne | 219/497 |
| 6,298,772 | B1 * | 10/2001 | Nguyen et al. | 99/327 |
| 8,063,341 | B2 * | 11/2011 | Iwasaki | 219/216 |
| 2010/0322656 | A1 * | 12/2010 | Chosokabe et al. | 399/67 |
| 2011/0064444 | A1 | 3/2011 | Adachi et al. | |

FOREIGN PATENT DOCUMENTS

| | | |
|---|---|---|
| JP | 8-202200 | 8/1996 |

* cited by examiner

*Primary Examiner* — Mark Paschall
(74) *Attorney, Agent, or Firm* — Oblon, Spivak, McClelland, Maier & Neustadt, L.L.P.

(57) ABSTRACT

A heater control device comprising: a storage unit that stores therein a turn-on pattern of a heater specified in units of a predetermined control cycle including a plurality of half-wavelengths of an alternating-current voltage supplied to the heater so as to prevent flickering;

a color temperature detecting unit that detects a color temperature of light emitted from a filament of the heater; and a heater control unit that, while operating in a standby mode in which power supplied to the heater is reduced, causes the heater to be fully turned ON at every first period, and then turns ON the heater in the turn-on pattern when the color temperature exceeds a predetermined threshold after the heater is fully turned ON.

11 Claims, 10 Drawing Sheets

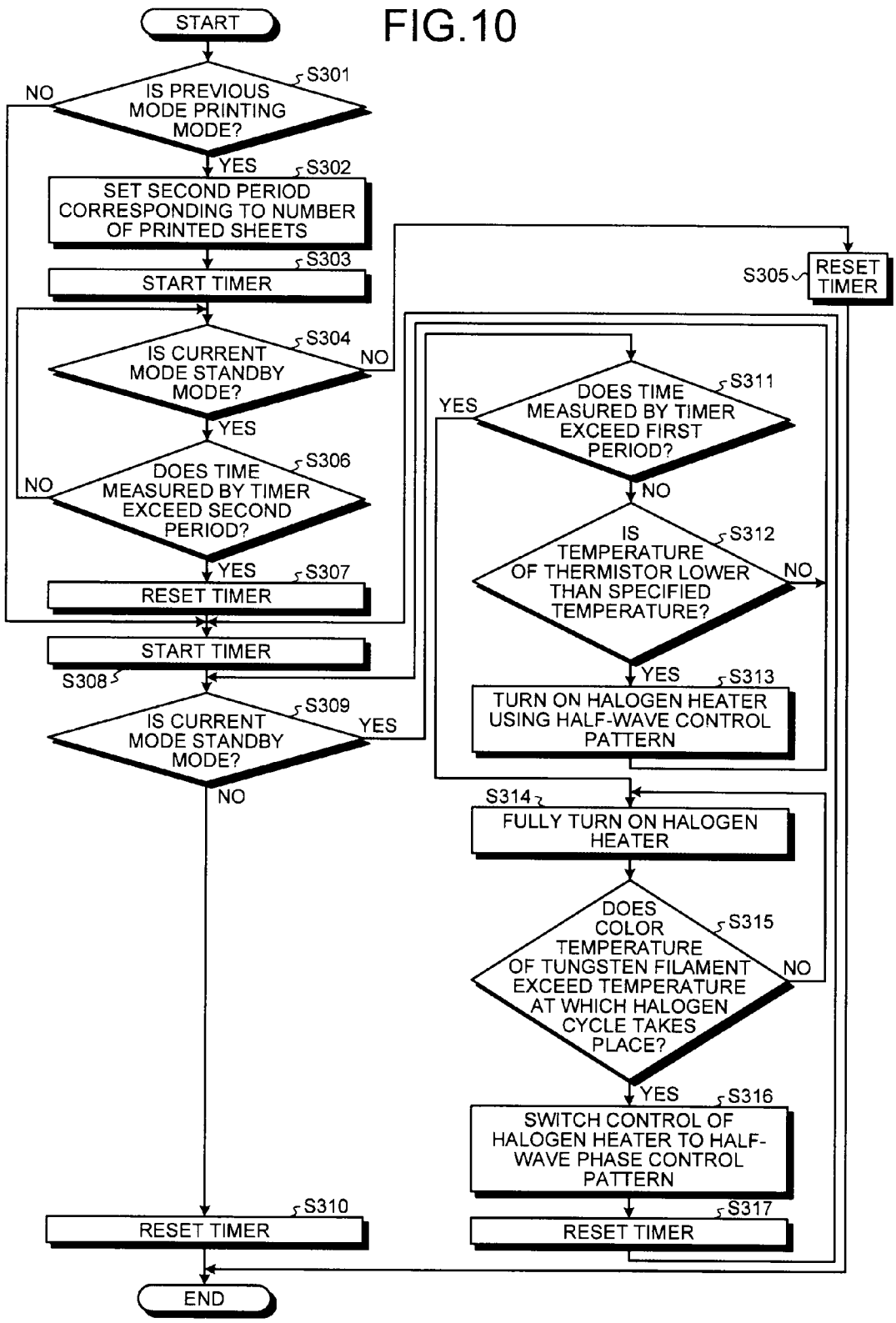
FIG.10
START
S301
IS PREVIOUS MODE PRINTING MODE?
NO
YES
S302
SET SECOND PERIOD CORRESPONDING TO NUMBER OF PRINTED SHEETS
S303
START TIMER
S304
IS CURRENT MODE STANDBY MODE?
NO
YES
S306
DOES TIME MEASURED BY TIMER EXCEED SECOND PERIOD?
NO
YES
S307
RESET TIMER
START TIMER
S308
S309
IS CURRENT MODE STANDBY MODE?
YES
NO
S310
RESET TIMER
END
S305
RESET TIMER
S311
DOES TIME MEASURED BY TIMER EXCEED FIRST PERIOD?
YES
NO
S312
IS TEMPERATURE OF THERMISTOR LOWER THAN SPECIFIED TEMPERATURE?
NO
YES
S313
TURN ON HALOGEN HEATER USING HALF-WAVE CONTROL PATTERN
S314
FULLY TURN ON HALOGEN HEATER
S315
DOES COLOR TEMPERATURE OF TUNGSTEN FILAMENT EXCEED TEMPERATURE AT WHICH HALOGEN CYCLE TAKES PLACE?
NO
YES
S316
SWITCH CONTROL OF HALOGEN HEATER TO HALF-WAVE PHASE CONTROL PATTERN
S317
RESET TIMER

HEATER CONTROL DEVICE, IMAGE FORMING APPARATUS, AND HEATER CONTROLLING METHOD

CROSS-REFERENCE TO RELATED APPLICATIONS

The present application claims priority to and incorporates by reference the entire contents of Japanese Patent Application No. 2010-132125 filed in Japan on Jun. 9, 2010.

BACKGROUND OF THE INVENTION

1. Field of the Invention

The present invention relates to a heater control device, an image forming apparatus, and a heater controlling method.

2. Description of the Related Art

Some electrophotographic image forming apparatuses use a fixing unit having a halogen heater. In such a halogen heater, a problem of break of a tungsten filament is likely to occur, especially in standby mode. Standby mode is an operation mode in which decreased power is supplied to units of the apparatus in comparison to normal mode in which a normal level of power is supplied. In the standby mode, at least the power supplied to the halogen heater is reduced.

From the viewpoint of reducing electricity consumption, the standby mode is used to control a halogen heater so that the halogen heater is kept ON with the lowest power that is needed to maintain a target temperature. However, with such a control, color temperature of the tungsten filament in the halogen heater does not reach the color temperature to realize a stable condition that is called a halogen cycle, in which halogen gas density in the halogen heater be kept uniform. Therefore, the halogen gas density in the halogen heater has been excessive to cause a phenomenon called a chemical attack, which has deteriorated a tungsten filament to cause to break.

In contrast, a tungsten filament in a halogen heater of a printing apparatus rarely breaks. This is because a fixing unit of the printing apparatus is often controlled in such a way that a sufficiently large amount of electricity is supplied to the fixing unit to fix toner onto a printing sheet in a printing process.

To prevent the tungsten filament from making a break in a halogen heater, Japanese Patent Application Laid-open No. H08-202200, for example, suggests a technique for switching a power supply to the halogen heater between ON and OFF such that the halogen heater is turned off after a rising in the color temperature of the tungsten filament is detected.

In Japanese Patent Application Laid-open No. H08-202200, a control is performed so that the halogen heater is turned ON to allow the halogen cycle to take place even during the standby mode and is turned off when the color temperature reaches the temperature at which the halogen cycle takes place. Therefore, it has been known that an excessive power is consumed or flickering gets worsened even in the standby mode.

SUMMARY OF THE INVENTION

It is an object of the present invention to at least partially solve the problems in the conventional technology.

According to an aspect of the present invention, there is provided a heater control device including: a storage unit that stores therein a turn-on pattern of a heater specified in units of a predetermined control cycle including a plurality of half-wavelengths of an alternating-current voltage supplied to the heater so as to prevent flickering; a color temperature detecting unit that detects a color temperature of light emitted from a filament of the heater; and a heater control unit that, while operating in a standby mode in which power supplied to the heater is reduced, causes the heater to be fully turned ON at every first period, and then turns ON the heater in the turn-on pattern when the color temperature exceeds a predetermined threshold after the heater is fully turned ON.

According to another aspect of the present invention, there is provided an image forming apparatus including: a storage unit that stores therein a turn-on pattern of a heater specified in units of a predetermined control cycle including a plurality of half-wavelengths of an alternating-current voltage supplied to the heater so as to prevent flickering; a color temperature detecting unit that detects a color temperature of light emitted from a filament of the heater; and a heater control unit that, while operating in a standby mode in which power supplied to the heater is reduced, causes the heater to be fully turned ON every time a first period elapses, and then turns ON the heater in the turn-on pattern when the color temperature exceeds a predetermined threshold after the heater is fully turned ON.

According to still another aspect of the present invention, there is provided a heater controlling method executed on a heater control device including a storage unit that stores therein a turn-on pattern of a heater specified in units of a predetermined control cycle including a plurality of half-wavelengths of an alternating-current voltage supplied to the heater so as to prevent flickering, the heater controlling method including: detecting a color temperature of light emitted from a filament of the heater; and controlling the heater, while the heater control device operates in a standby mode in which power supplied to the heater is reduced, so as to cause the heater to be fully turned ON every time a first period elapses, and to turn ON the heater in the turn-on pattern when the color temperature exceeds a predetermined threshold after the heater is fully turned ON.

The above and other objects, features, advantages and technical and industrial significance of this invention will be better understood by reading the following detailed description of presently preferred embodiments of the invention, when considered in connection with the accompanying drawings.

BRIEF DESCRIPTION OF THE DRAWINGS

FIG. 10 is a flowchart of an example of a heater controlling process performed by an image forming apparatus according to the third embodiment;

DETAILED DESCRIPTION OF THE PREFERRED EMBODIMENTS

Exemplary embodiments of a heater control device, an image forming apparatus, a heater controlling method, and a computer program according to the present invention are described below in greater detail with reference to the accompanying drawings. The image forming apparatus according to the present invention may be applied to any image forming apparatus such as a copying machine, a printer, a scanner, a facsimile, and a multi-functional product (MFP) including at least two functions from among a following list: a copying function, a printer function, a scanner function, and a facsimile function.

In the explanation below, an example of a halogen heater including a tungsten filament as a filament is used. However, the present invention may be applied to any other heaters in which the filament could break when power consumption is reduced.

First Embodiment

Figure 1:
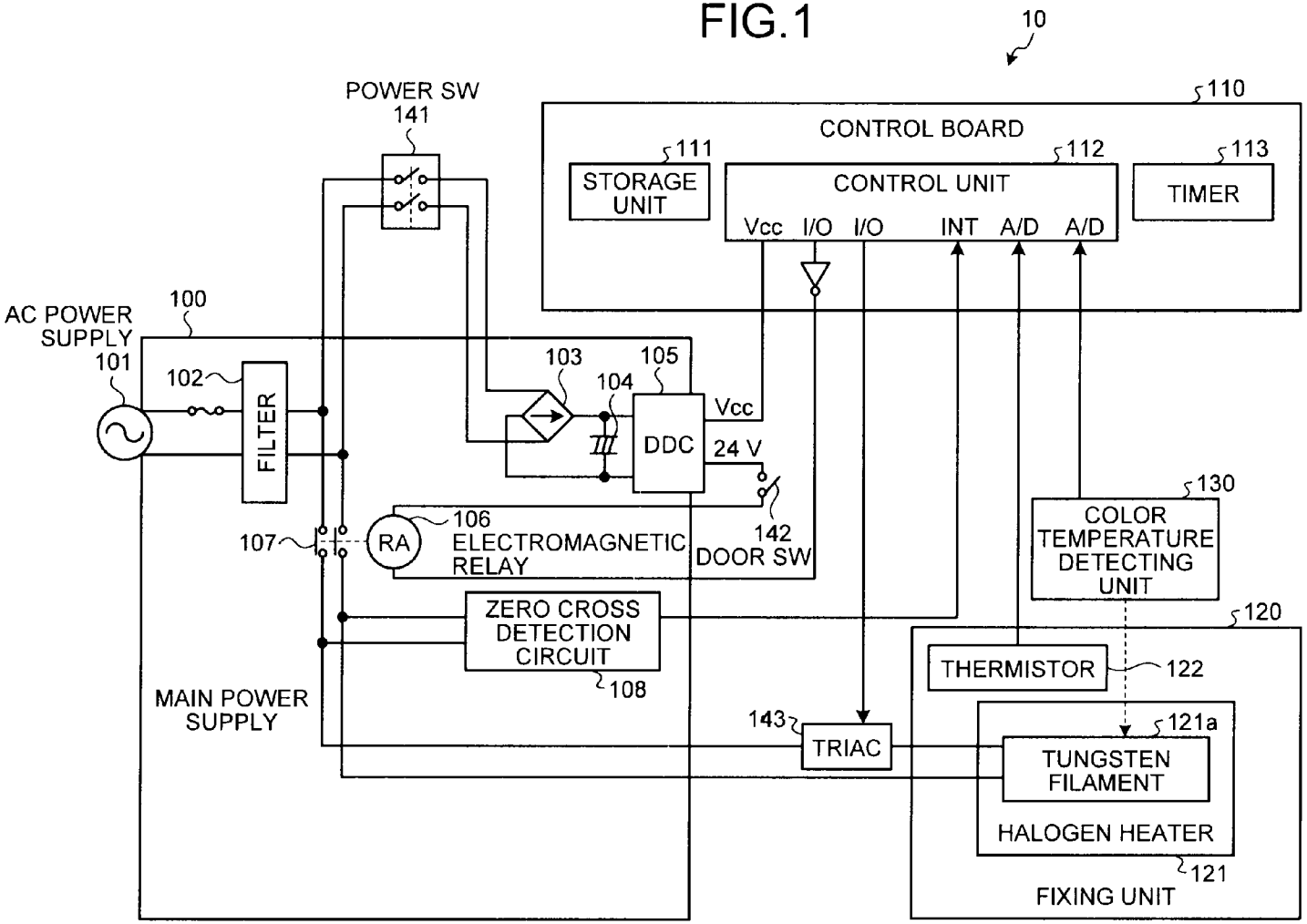
FIG. 1 is a block diagram of an entire structure of an image forming apparatus.

FIG. 1 is a block diagram of an entire structure of an image forming apparatus 10. The image forming apparatus 10 includes a heater control device that controls a heater used for a fixing unit and the like included in the image forming apparatus 10. More specifically, the image forming apparatus 10 mainly includes a main power supply 100 and a control board 110. The image forming apparatus 10 further includes a fixing unit 120, a color temperature detecting unit 130, a power switch (SW) 141, a door SW 142, and a triode alternating current switch (TRIAC) 143.

The fixing unit 120 includes a halogen heater 121 which further includes a tungsten filament 121*a*, and a thermistor 122 located near the halogen heater 121.

The control board 110 controls the entire image forming apparatus 10. The control board 110 is implemented as a computer having a central processing unit (CPU), a random access memory (RAM), a read-only memory (ROM), a non-volatile random access memory (NVRAM), an application specific integrated circuit (ASIC), and an input-output interface that are connected via a bus, none of which are illustrated.

The control board 110 controls a temperature and a switching between ON and OFF of the halogen heater 121 in the fixing unit 120 by controlling ON/OFF of the TRIAC 143 that is arranged between the main power supply 100 and the fixing unit 120 or an electromagnetic relay 106.

The thermistor 122 arranged near the halogen heater 121 detects surface temperature of the halogen heater 121. A temperature detecting unit detecting the surface temperature is not limited to the thermistor 122, and may be any temperature detecting element, e.g., a thermopile having conventionally been used.

The control board 110 detects, via an analog-to-digital (A/D) conversion, the surface temperature of the halogen heater 121 through the detection by the thermistor 122. The control board 110 controls ON/OFF of the TRIAC 143 and the electromagnetic relay 106 so as to stabilize the surface temperature of the halogen heater 121.

When the power switch (SW) 141 of the image forming apparatus 10 is turned ON, noise in the current supplied by the alternating current (AC) power supply 101 is removed by a filter 102, and the current is smoothed by a rectifier diode 103 and a smoothing capacitor 104, and supplied to a digital down converter (DDC) 105. The DDC 105 is a switching-based direct current-to-direct current (DC-to-DC) converter, and supplies a constant voltage Vcc to the control board 110 and supplies 24 volts to the electromagnetic relay 106.

When the door SW 142 of the image forming apparatus 10 is turned ON, the electromagnetic relay 106 can turn ON a switch 107, and turn OFF the fixing unit 120 via the control board 110. In other words, the door SW 142 functions as a safety mechanism for the fixing unit 120.

A zero cross detection circuit 108 detects a zero-crossing point of the AC power supply 101. The control board 110 turns ON/OFF the TRIAC 143 at the zero-crossing point. When the switch 107 is ON, the voltage of the alternating current supplied to the zero cross detection circuit 108 becomes close to zero at a cycle of every half-wavelength. Therefore, a transistor in the zero cross detection circuit 108 becomes incapable of maintaining an ON voltage. The zero cross detection circuit 108 detects this condition of the transistor, and outputs a zero crossing signal to the control board 110. In a phase control (to be described later), an operational timing of the phase control is controlled based on the operational timing of detection of the zero crossing signal.

The control board 110 includes a storage unit 111, a control unit 112, and a timer 113. The control unit 112 controls the entire imaging apparatus. Functions of the control unit 112 can be realized by software executed by the CPU, for example.

The color temperature detecting unit 130 detects the color temperature of the light emitted from the tungsten filament 121*a* in the halogen heater 121, and transmits a detection result to the control unit 112. The color temperature detecting unit 130 may be realized as an illuminance sensor, for example.

Figure 2:
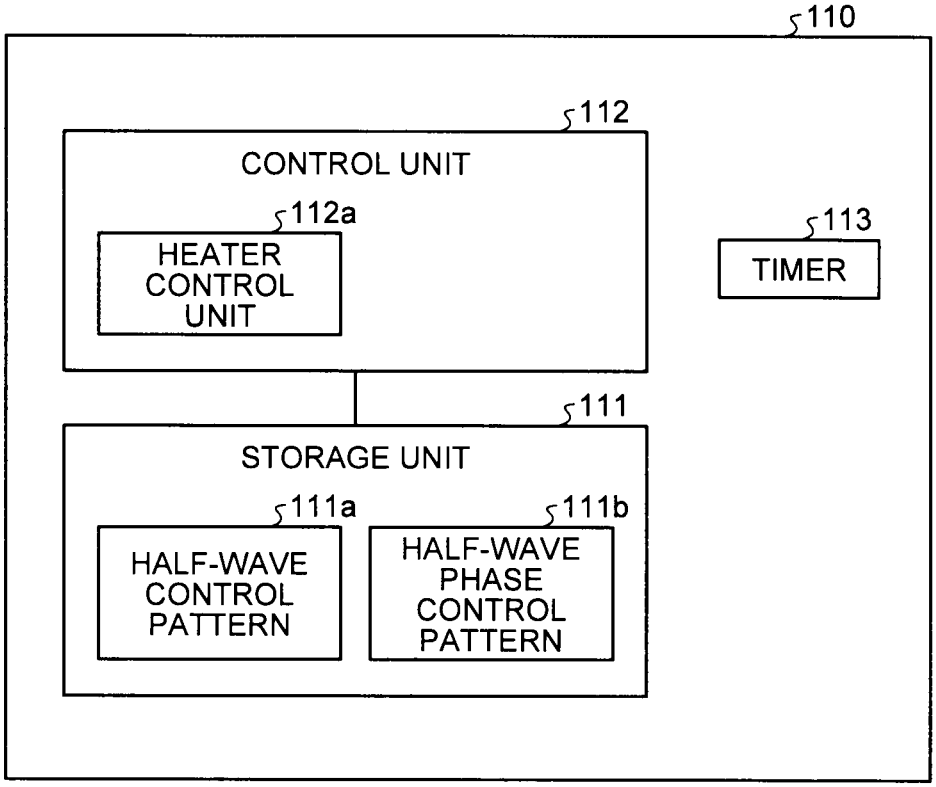
FIG. 2 is a functional block diagram of exemplary functions of a control board according to a first embodiment of the present invention.

FIG. 2 is a functional block diagram of exemplary functions of the control board 110 according to the first embodiment. As illustrated in FIG. 2, the control unit 112 includes a heater control unit 112*a* as a main functional component thereof.

The heater control unit 112*a* controls to turn ON the halogen heater 121. More specifically, first, the heater control unit 112*a* determines an ON duty of the halogen heater 121 from the surface temperature of the halogen heater 121 detected by the thermistor 122 and a target temperature. Second, the heater control unit 112*a* controls to turn ON the halogen heater 121 in units of half a wavelength of the alternating-current voltage, following a turn-on pattern determined based on the ON duty thus determined.

The heater control unit 112*a* reduces flickering using the minimum power required upon operating in the standby mode, while controlling to turn ON the halogen heater 121 in a manner preventing the break of the filament in the heater. A turn-on control of the halogen heater 121 performed by the heater control unit 112*a* will be described later in detail. The heater control unit 112*a* may also be arranged outside the control unit 112.

The storage unit 111 stores therein various types of information required in the ON control of the halogen heater 121. For example, the storage unit 111 stores therein a half-wave control pattern 111*a* and a half-wave phase control pattern 111*b* that are patterns at which the halogen heater 121 is to be turned ON and are determined in units of a control cycle so as to prevent flickering.

The half-wave control pattern 111*a* is a turn-on pattern used in a half-wave control in which the heater is controlled to turn on in units of a period of time that is equal to ten half-waves of the alternating-current voltage so as to reduce flickering. Techniques for the turn-on control of the heater to reduce flickering other than the half-wave control include a phase control in which the heater is turned ON only in a part of a half-wavelength, and a half-wave phase control in which the half-wave control and the phase control are combined. The half-wave phase control pattern 111*b* is a turn-on pattern used in the half-wave phase control for preventing flickering.

The control cycle is a cycle which is an integer multiple of a cycle of the voltage in the AC power supply 101 controlled by the control board 110, and has a predetermined period of time. In the first embodiment, the control cycle is set to ten half-wavelengths. The storage unit 111 stores therein the turn-on patterns in units of ten half-wavelengths corresponding to the control cycle. The control cycle is not limited to ten half-wavelengths, and may be a period of time that is an integer multiple of ten half-wavelengths, for example.

Figure 3:
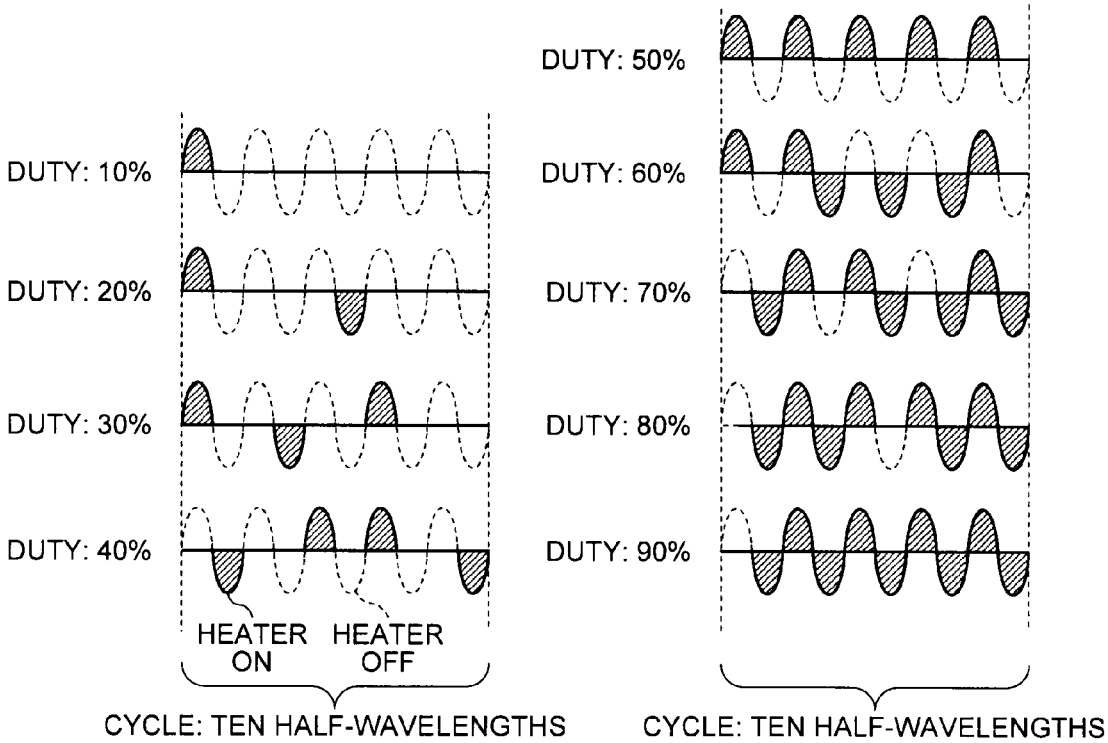
FIG. 3 is a graph of an example of a half-wave control pattern.
Figure 4:
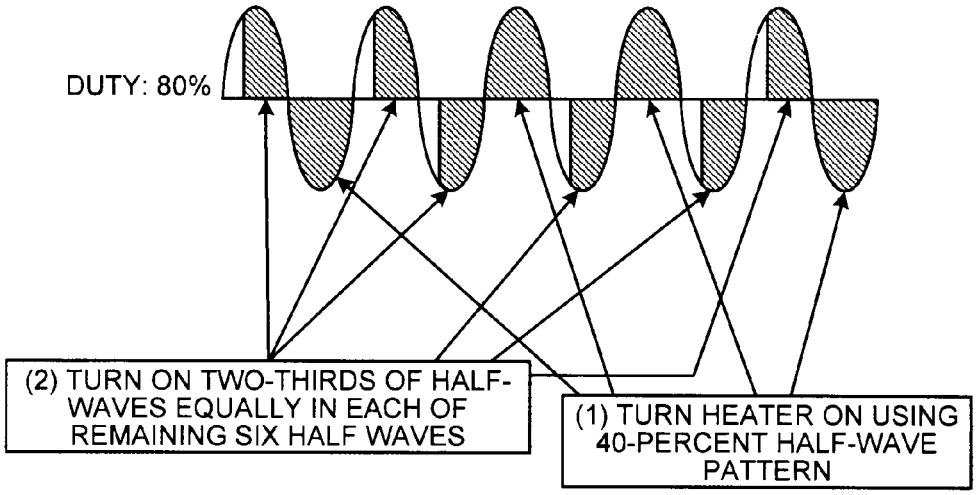
FIG. 4 is a graph of an example of a half-wave phase control pattern.

The half-wave control pattern 111*a* and the half-wave phase control pattern 111*b* are explained in detail with reference to FIGS. 3 and 4. Graphs in FIG. 3 are an example of the half-wave control pattern 111*a*. A graph in FIG. 4 is an example of the half-wave phase control pattern 111*b*.

Human eyes are most sensitive to light fluctuations in the frequency range near 10 Hz having its center at 8.8 Hz.

The half-wave control is a technique of shifting the control operational timing at which the heater is turned ON so that the flickering is not in a frequency range which human eyes are most sensitive to, or to reduce flickering in the frequency range as much as possible. That is, in the half-wave control, the control cycle for changing a cycle at which the heater is turned ON is set to ten half-wavelengths that are close to 10 Hz to which human eyes are sensitive, and the frequency of the turn-on pattern in the control cycle is controlled so as to keep the turn-on pattern to be in a predetermined high frequency and to avoid the bandwidth near 10 Hz.

FIG. 3 is a graph of an example of half-wave control patterns when the ON duty is from 10 percent to 90 percent. FIG. 3 depicts an example of patterns in which the heater is turned ON in hatched half-waves, and is turned OFF in the other half-waves.

FIG. 4 is a graph of an example of the half-wave phase control pattern 111*b* when the ON duty is 80 percent. The half-wave phase control pattern 111*b* is created based on the half-wave control pattern 111*a* illustrated in FIG. 3. An exemplary method of creating the half-wave phase control pattern 111*b* is explained.

For a particular ON duty, the half-wave control pattern 111*a* equal to or less than and closest to one half of such an ON duty is selected as a base. For example, when ON duty is 80 percent, because 80 percent×½=40 percent, the half-wave control pattern 111*a* having a 40-percent ON duty is used as a base. When the ON duty is 70 percent, because 70 percent×1½=35 percent, the half-wave control pattern 111*a* with a 30-percent ON duty, which is equal to or less than and closest to one half of such an ON duty, is used as a base.

ON half-waves in the base half-wave control pattern 111*a* are kept as ON. The target ON duty subtracted by the ON duty of the base half-wave control pattern 111*a* is then equally divided and assigned to each of the remaining OFF half-waves. In other words, the value obtained by dividing the remaining ON duty by the number of the remaining OFF half-waves is assigned to each of the OFF half-waves to turn ON the OFF half-waves thus processed in the phase control.

A method of creating the half-wave phase control pattern 111*b* having 80-percent ON duty in FIG. 4, using the half-wave control pattern 111*a* illustrated in FIG. 3 as a base, is explained below.

(1) As described above, when the ON duty is 80 percent, the half-wave control pattern 111*a* having 40-percent ON duty is used as a base. In the half-wave control pattern 111*a* having 40-percent ON duty illustrated in FIG. 3, the second, the fifth, the seventh, and the tenth half-waves are turned ON. Therefore, the second, the fifth, the seventh, and the tenth half-waves are fully turned ON also in the half-wave phase control pattern 111*b* that is to be created.

(2) The remaining 40-percent ON duty (corresponding to four half-waves) is equally assigned to the remaining six half-waves that are kept OFF in the half-wave control pattern 111*a* having 40-percent ON duty, and the phase control is performed therewith. That is, two thirds of half-waves are turned ON in each of the remaining six half-waves. Here, the value of two thirds is derived by dividing four half-waves by six (4 half-waves/6=⅔).

In this manner, in the half-wave phase control pattern 111*b*, the heater is turned ON in all of the ten half-waves. Therefore, fluctuations caused by the temperature can be reduced, a fixing control can be maintained so that the halogen cycle can take place, and flickering can be reduced as well.

Figure 5:
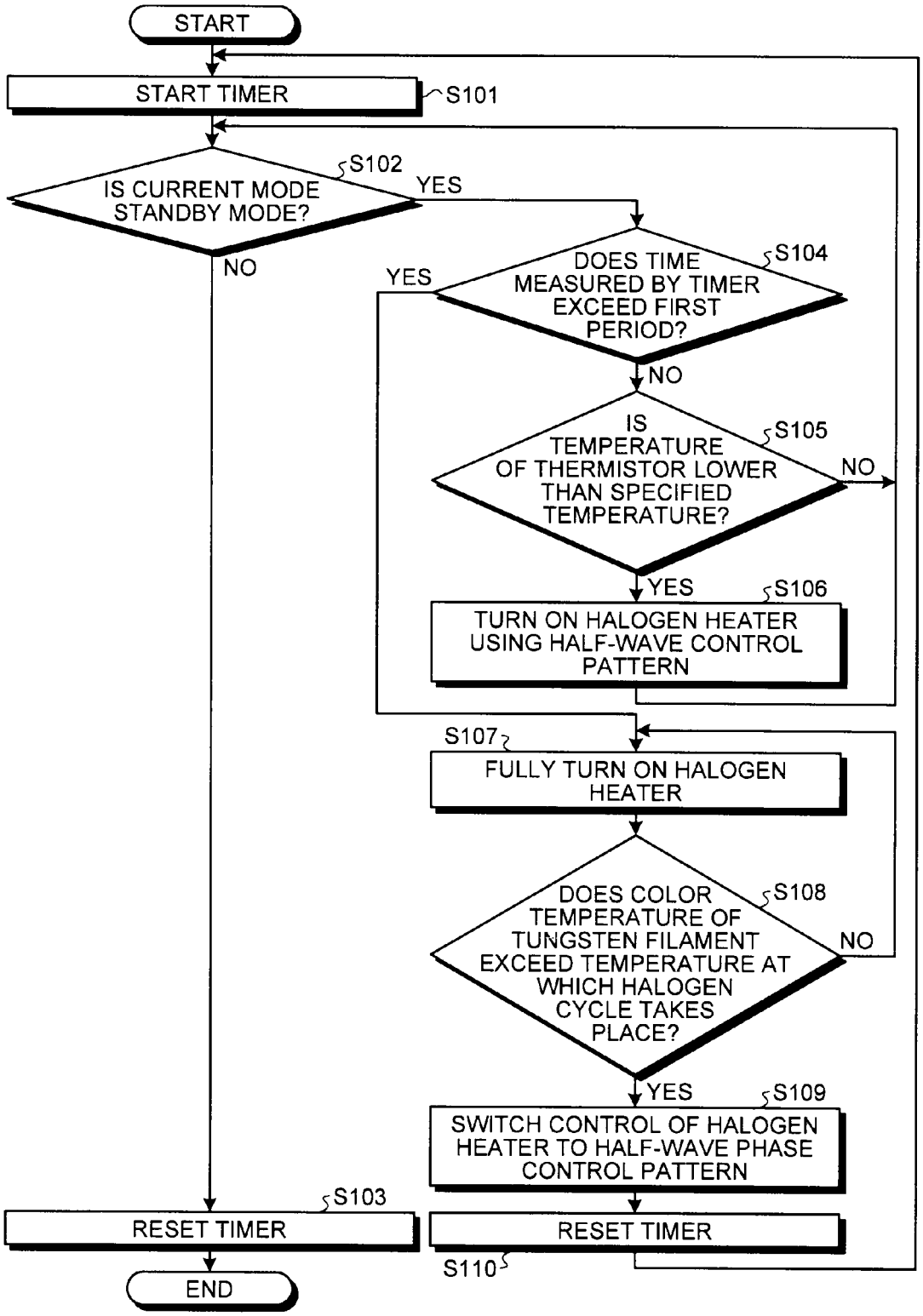
FIG. 5 is a flowchart of an example of a heater controlling process performed by the image forming apparatus according to the first embodiment.

A heater controlling process performed by the image forming apparatus 10 according to the first embodiment having such a structure is explained with reference to FIG. 5. FIG. 5 is a flowchart of an example of the heater controlling process performed by the image forming apparatus 10 according to the first embodiment. FIG. 5 depicts a process of an ON control of the halogen heater 121 during the standby mode.

When the image forming apparatus 10 enters the standby mode, the heater control unit 112*a* starts measuring time using the timer 113 (Step S101). The heater control unit 112*a* then determines whether or not the current mode is the standby mode (Step S102). If the current mode is not the standby mode (NO at Step S102), the heater control unit 112*a* resets the time measured by the timer 113 (Step S103), and ends the process. If the current mode is the standby mode (YES at Step S102), the heater control unit 112*a* determines whether or not the time measured by the timer 113 exceeds a predetermined period of time (a first period) (Step S104).

If the measured time has not exceeded the first period (NO at Step S104) yet, the heater control unit 112*a* determines whether or not the surface temperature detected by the thermistor 122 is lower than a specified temperature that is a predetermined temperature to turn ON the halogen heater 121 (Step S105). If the surface temperature is not lower than the specified temperature (NO at Step S105), system control returns to Step S102 and repeats the process.

If the surface temperature is lower than the specified temperature (YES at Step S105), the heater control unit 112*a* turns ON the halogen heater 121 with the minimum power by using the half-wave control pattern 111*a* for preventing flickering (Step S106). The heater control unit 112*a* turns OFF the halogen heater 121 after a lapse of a predetermined time, and the system control returns to Step S102 and repeats the process.

If the measured time has exceeded the first period (YES at Step S104), the heater control unit 112*a* fully turns ON the halogen heater 121 (Step S107). The heater control unit 112*a* then determines whether or not the color temperature of the tungsten filament 121*a* detected by the color temperature detecting unit 130 has exceeded a threshold that is a predetermined color temperature at which the halogen cycle takes place (Step S108).

If the detected color temperature has not exceeded the threshold (NO at Step S108), the system control returns to Step S107, and repeats the process. If the detected color temperature has exceeded the threshold (YES at Step S108), the heater control unit 112*a* switches the turn-on pattern of the halogen heater 121 to the half-wave phase control pattern 111*b* for preventing flickering (Step S109). The heater control unit 112*a* then turns ON the halogen heater 121 with the minimum power required for maintaining the halogen cycle until a predetermined specified time elapses, and turns OFF the halogen heater 121 when the specified time arrives. The heater control unit 112*a* then resets the time measured by the timer 113 (Step S110), and the system control returns to Step S101, and repeats the process.

Figure 6:
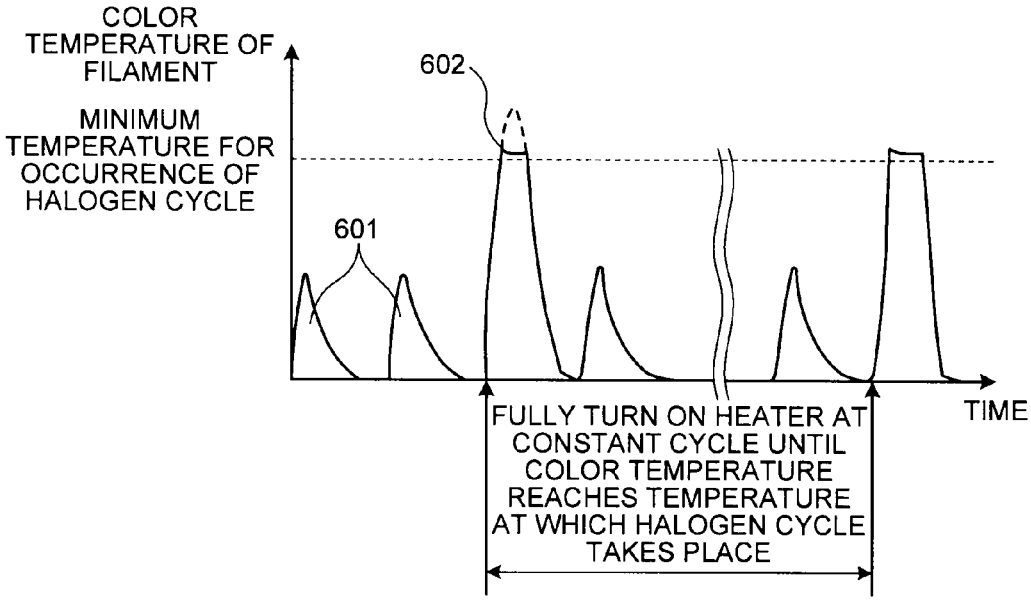
FIG. 6 is a graph of an example of a temporal change of the color temperature of a tungsten filament when the heater controlling process illustrated in FIG. 5 is performed.

FIG. 6 is a graph showing an example of the transition in the color temperature of the tungsten filament 121*a* when the heater controlling process illustrated in FIG. 5 is performed.

Regions 601 illustrated in FIG. 6 represent the color temperature changed by the half-wave control performed using the half-wave control pattern 111*a*. After the half-wave control is executed, the halogen heater 121 is fully turned ON in a constant cycle (at every passage of the first period) until the halogen heater 121 reaches the color temperature for entering the halogen cycle (the minimum temperature for the halogen cycle to take place). When the color temperature exceeds the minimum temperature for the halogen cycle to take place, the half-wave control using the half-wave control pattern 111*a* is switched to the half-wave phase control using the half-wave phase control pattern 111*b*, and the color temperature near the minimum temperature for allowing the halogen cycle to take place is maintained (region 602) until the halogen heater 121 is turned OFF.

In this manner, according to the first embodiment, in the standby mode, in addition to a method to control the halogen heater 121 to turn ON with the minimum power using the half-wave control pattern 111*a* for preventing flickering, a turn-on control of the heater is also used to cause the halogen cycle in the halogen heater at a constant cycle. By so doing, the break of the tungsten filament 121*a* caused by the excessive halogen gas density in the halogen heater 121 can be prevented.

Furthermore, the color temperature of the tungsten filament 121*a* is detected while the turn-on control of the heater proceeds to cause the halogen cycle, and when the detected color temperature reaches the color temperature at which the halogen cycle takes place, the turn-on pattern of the halogen heater 121 is switched to the half-wave phase control pattern that is designed to prevent flickering to keep the halogen heater 121 ON with the minimum power required for maintaining the halogen cycle during a specified period of time that follows thereafter. It is possible to reduce flickering and to save power accordingly.

Second Embodiment

If a mode of the image forming apparatus immediately before entering the standby mode is, for example, a mode for executing printing (referred to as a printing mode, hereinafter), turn-on control of a heater has been performed with a sufficient power to cause the halogen cycle and to keep the halogen density uniform, because toner needs to be fixed to a printing sheet. An image forming apparatus according to a second embodiment of the present invention performs the turn-on control of the heater by considering a condition of the image forming apparatus immediately before entering the standby mode like the above.

Figure 7:
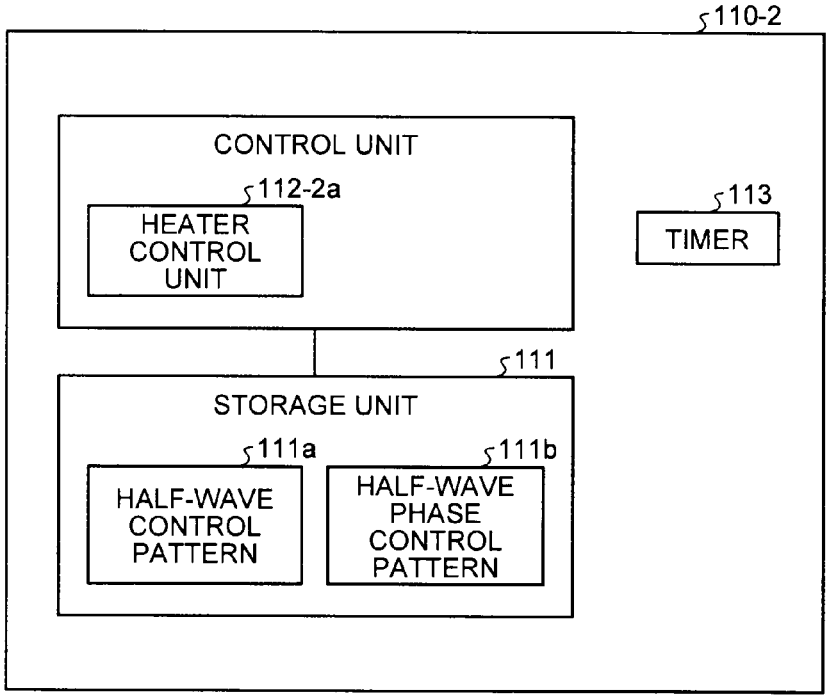
FIG. 7 is a functional block diagram of exemplary functions of a control board according to a second embodiment of the present invention.

FIG. 7 is a functional block diagram of exemplary functions of a control board 110-2 according to the second embodiment. Because the structures other than the control board 110-2 are the same as those illustrated in FIG. 1, explanations thereof are omitted herein.

In the control board 110-2, the function of a heater control unit 112-2*a* is different from that included in the control board 110 according to the first embodiment.

The heater control unit 112-2*a* is different from the heater control unit 112*a* according to the first embodiment in that, when the image forming apparatus enters the standby mode, the heater control unit 112-2*a* determines whether or not the mode of the image forming apparatus immediately before entering the standby mode is the printing mode, and if the mode immediately before entering the standby mode is the printing mode, the heater control unit 112-2*a* starts the process explained in the first embodiment after passage of a predetermined period of time (second period).

Figure 8:
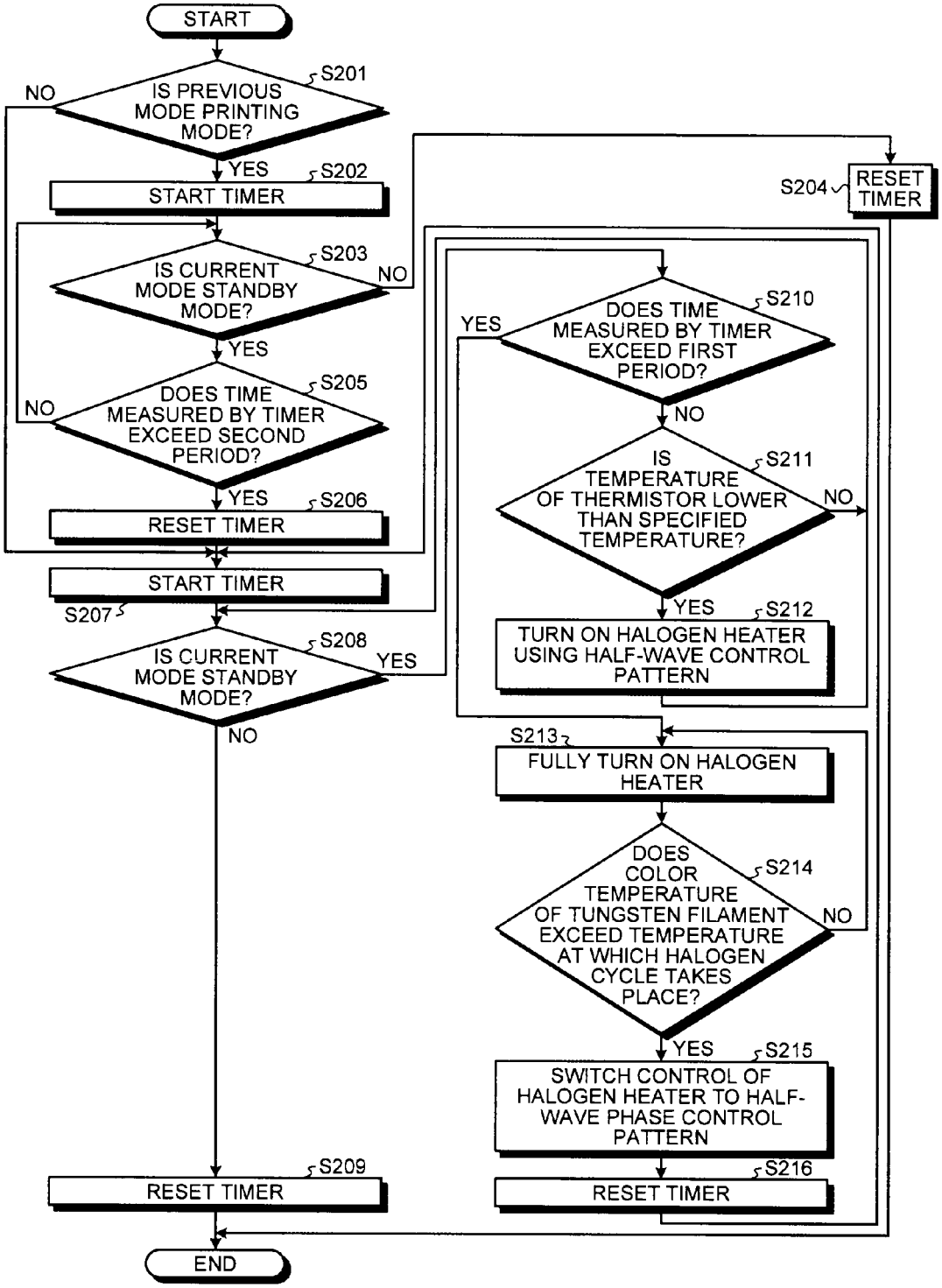
FIG. 8 is a flowchart of an example of a heater controlling process performed by an image forming apparatus according to the second embodiment.

A heater controlling process performed by the image forming apparatus according to the second embodiment having such a structure is explained with reference to FIG. 8. FIG. 8 is a flowchart of an example of the heater controlling process performed by the image forming apparatus according to the second embodiment.

When the image forming apparatus enters the standby mode, the heater control unit 112-2*a* determines whether or not the mode of the image forming apparatus immediately before entering the standby mode is the printing mode (Step S201). If the mode immediately before entering the standby mode is the printing mode (YES at Step S201), the heater control unit 112-2*a* starts measuring time using the timer 113 (Step S202). The heater control unit 112-2*a* then determines whether or not the current mode is the standby mode (Step S203). If the current mode is not the standby mode (NO at Step S203), the heater control unit 112-2*a* resets the time measured by the timer 113 (Step S204), and ends the process. If the current mode is the standby mode (YES at Step S203), the heater control unit 112-2*a* determines whether or not the time measured by the timer 113 exceeds the predetermined period of time (second period) (Step S205).

If the measured time has not exceeded the second period (NO at Step S205), system control returns to Step S203, and repeats the process. If the measured time has exceeded the second period (YES at Step S205), the heater control unit 112-2*a* resets the time measured by the timer 113 (Step S206).

If the mode immediately before entering the standby mode is not the printing mode (NO at Step S201), and after the time measured by the timer 113 is reset at Step S206, the same processes as those from Step S101 to Step S110 illustrated in FIG. 5 are executed (Steps from S207 to S216).

In the example explained above, the heater control unit 112-2*a* determines whether or not the mode of the image forming apparatus immediately before entering the standby mode is the printing mode. However, the same process can be applied to any mode amongst modes in which the normal power is supplied to at least the halogen heater 121 (normal mode).

In the second embodiment, depending on the mode of the image forming apparatus immediately before entering the standby mode, restriction is given to turn ON the halogen heater 121 for a certain period of time. Therefore, it is possible to reduce the number of times the heater is turned ON immediately after entering the standby mode so as to prevent the tungsten filament 121*a* from breaking. Accordingly, the power can be saved more than that saved in the first embodiment.

Third Embodiment

In a third embodiment of the present invention, if the mode immediately before entering the standby mode is the printing mode, the period of time in which the halogen heater 121 is restricted from being turned ON (second period) is set depending on the number of sheets to which image formation is performed (the number of printed sheets).

Figure 9:
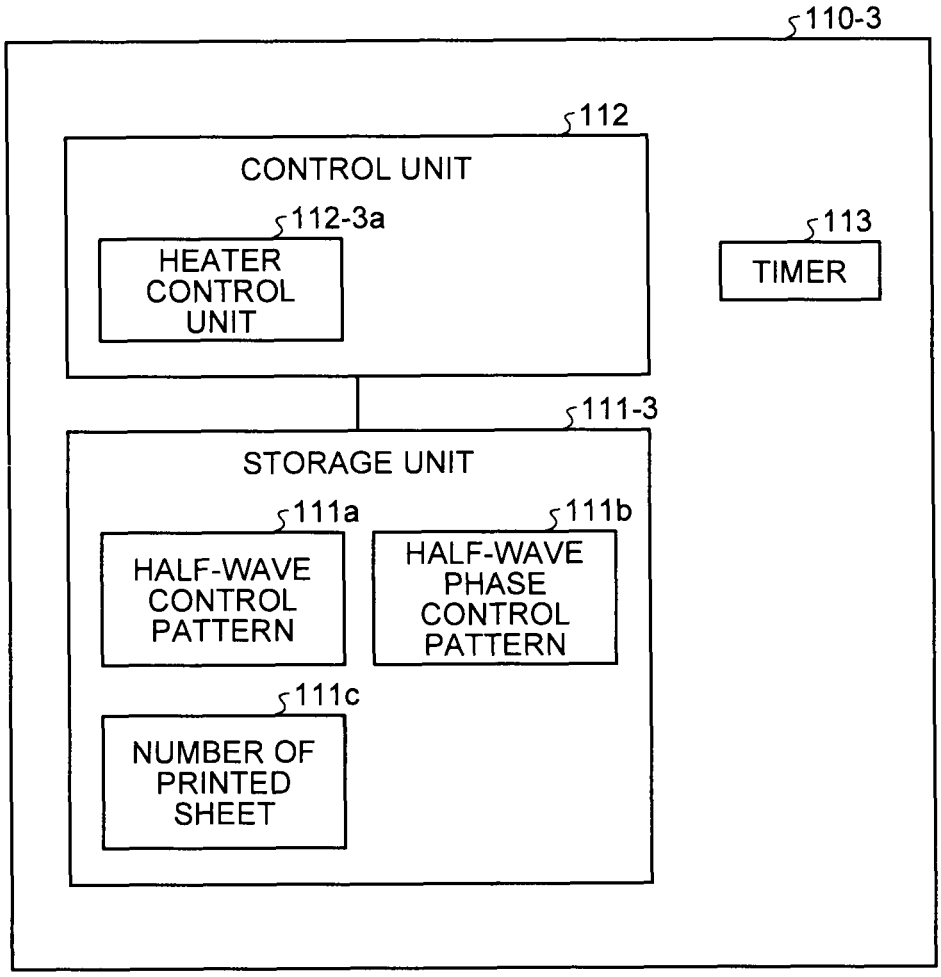
FIG. 9 is a functional block diagram of exemplary functions of a control board according to a third embodiment of the present invention.

FIG. 9 is a functional block diagram of exemplary functions of a control board 110-3 according to the third embodiment. Because the structures other than the control board 110-3 are the same as those illustrated in FIG. 1, explanations thereof are omitted herein.

The control board 110-3 is different from the control board 110-2 according to the second embodiment in that a heater control unit 112-3*a* has a different function and that a storage unit 111-3 further stores therein the number of printed sheets 111*c*.

The heater control unit 112-3*a* is different from the heater control unit 112-2*a* according to the second embodiment in that the heater control unit 112-3*a* further includes a function for setting the second period that is a lapse of time for the heater control unit 112-3*a* to transit to the turn-on control in the standby mode depending on the number of sheets printed in the printing mode immediately before entering the standby mode.

The number of printed sheets 111*c* indicates the number of sheets printed in the printing mode after the image forming apparatus transits from the standby mode to the printing mode, for example. The heater control unit 112-3*a* sets the second period corresponding to the number of printed sheets 111*c* stored in the storage unit 111-3 by referring to a table (not illustrated) associating the number of printed sheets with the second period, for example. However, a technique of setting the second period depending on the number of printed sheets is not limited thereto. For example, the heater control unit 112-3*a* may use a predetermined calculation formula to calculate the second period corresponding to the number of printed sheets.

A heater controlling process performed by the image forming apparatus according to the third embodiment having such a structure is explained with reference to FIG. 10. FIG. 10 is a flowchart of an example of the heater controlling process performed by the image forming apparatus according to the third embodiment.

The heater controlling process according to the third embodiment is different from the heater controlling process according to the second embodiment illustrated in FIG. 8 in that the heater controlling process according to the third embodiment further includes a process of setting the second period corresponding to the number of printed sheets 111*c* printed by the image forming apparatus immediately before entering the standby mode and stored in the storage unit 111-3 (Step S302). Because Step S301 and Steps from S303 to Step S317 are the same process as the Steps from S201 to S216 illustrated in FIG. 8, explanations thereof are omitted herein.

In this manner, according to the third embodiment, when the number of printed sheets is large, the period of time (second period) to be compared with the time measured by the timer can be extended according to the number of printed sheets. In other words, it is possible to adjust the time that the heater control unit 112-3*a* takes before entering the turn-on control of the heater for preventing break of the tungsten filament 121*a* immediately after the image forming apparatus enters the standby mode. Accordingly, the power can be saved more than that saved in the second embodiment.

Forth Embodiment

In a fourth embodiment according to the present invention, the first period which is the cycle at which the halogen heater is fully turned ON is changed depending on a duration in which the image forming apparatus has been in use.

Figure 11:
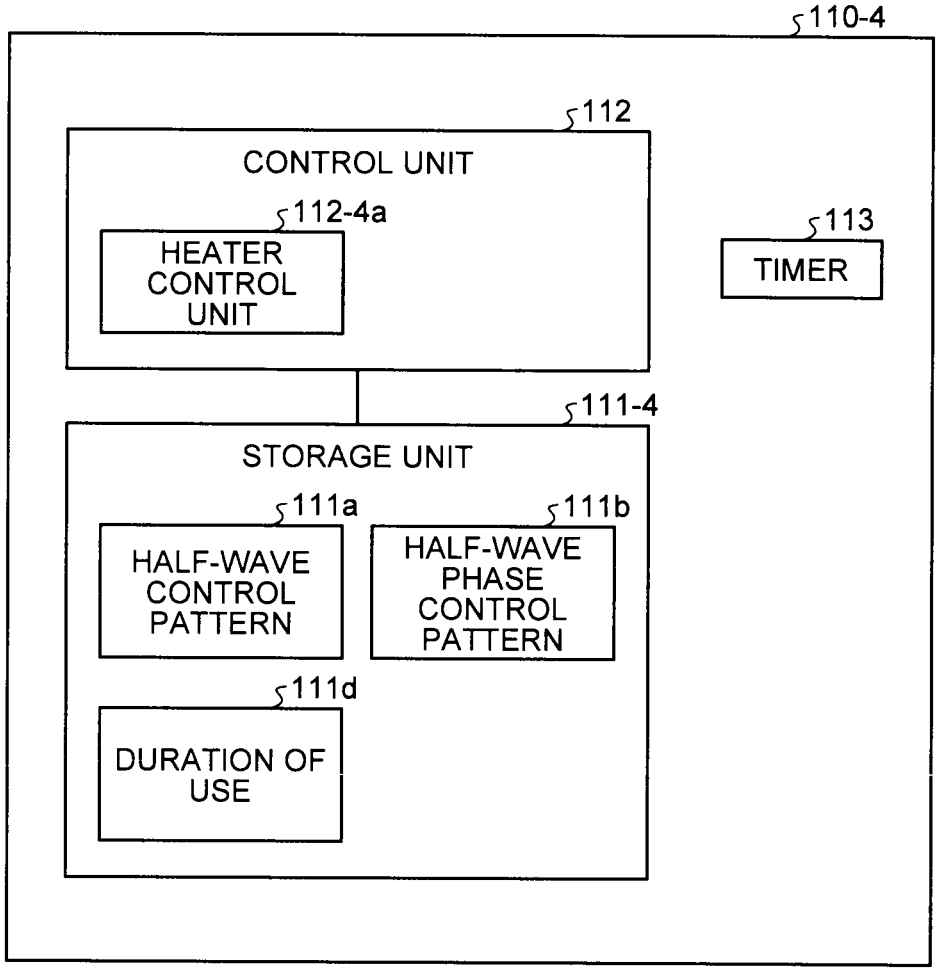
FIG. 11 is a functional block diagram of exemplary functions of a control board according to a fourth embodiment of the present invention.

FIG. 11 is a functional block diagram of exemplary functions of a control board 110-4 according to the fourth embodiment. Because the structures other than the control board 110-4 are the same as those illustrated in FIG. 1, explanations thereof are omitted herein.

The control board 110-4 is different from the control board 110 according to the first embodiment in that a heater control unit 112-4*a* has a different function and that a storage unit 111-4 stores therein a duration of use 111*d*.

The heater control unit 112-4*a* is different from the heater control unit 112*a* according to the first embodiment in that the heater control unit 112-4*a* further includes a function of setting the first period corresponding to the time for which the image forming apparatus has been in use. The heater control unit 112-4*a* sets the first period corresponding to the duration of use 111*d* stored in the storage unit 111-4 by referring to a table (not illustrated) associating the duration of use and the first period, for example. However, a technique of deciding the first period corresponding to the duration of use is not limited thereto. For example, the heater control unit 112-4*a* may use a predetermined calculation formula to calculate the first period corresponding to the duration of use.

Figure 12:
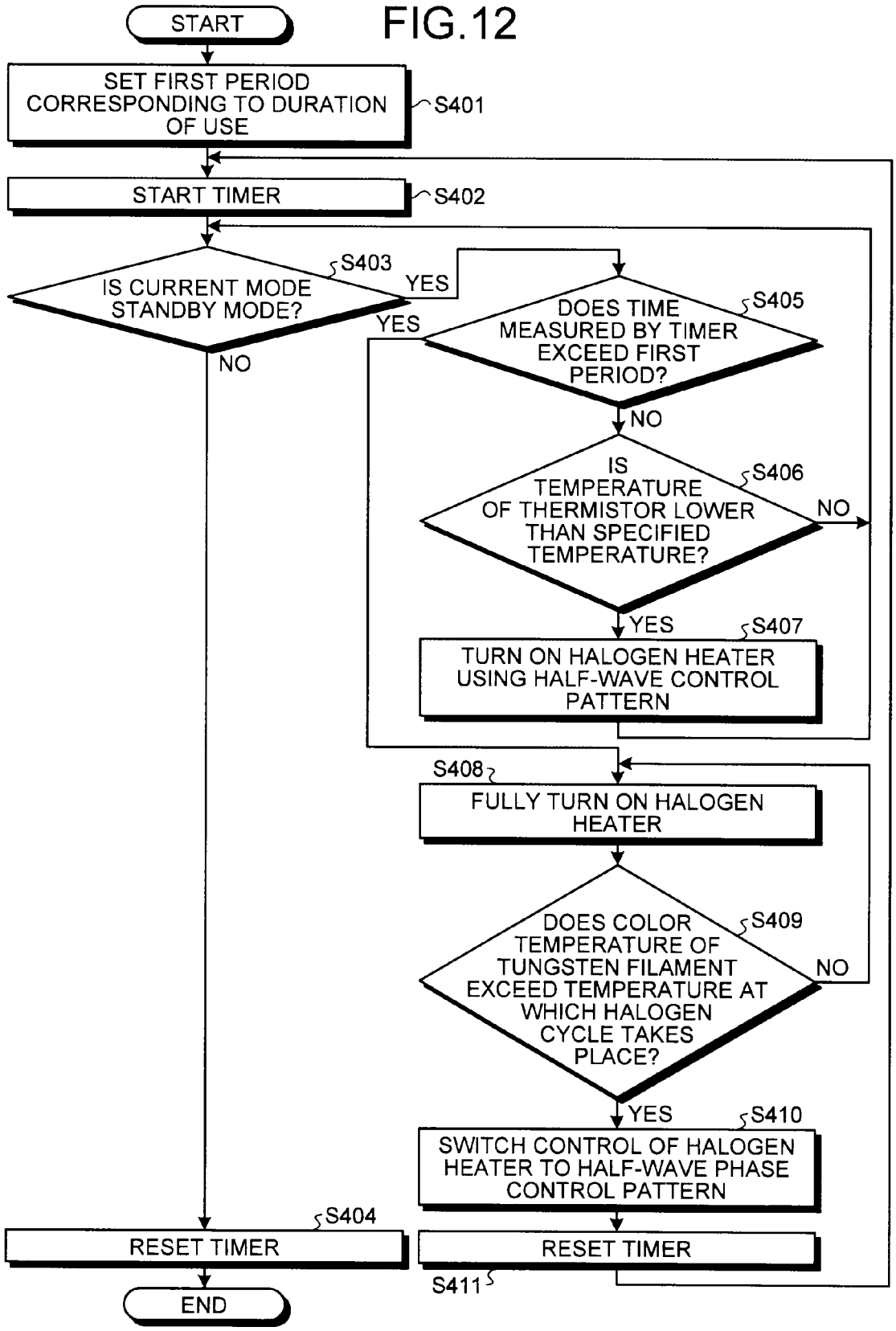
FIG. 12 is a flowchart of an example of a heater controlling process performed by an image forming apparatus according to the fourth embodiment.

A heater controlling process performed in the image forming apparatus according to the fourth embodiment having such a structure will now be explained with reference to FIG. 12. FIG. 12 is a flowchart of an example of the heater controlling process performed by the image forming apparatus according to the fourth embodiment.

The heater controlling process according to the fourth embodiment is different from the heater controlling process according to the first embodiment illustrated in FIG. 5 in that the heater controlling process according to the fourth embodiment further includes a process of setting the first period corresponding to the duration of use 111*d* stored in the storage unit 111-4 (Step S401). Because the other Steps, which are from S402 to S411, are similar to Steps from S101 to S110 illustrated in FIG. 5, explanations thereof are omitted herein.

In this manner, according to the fourth embodiment, the cycle at which the halogen heater is fully turned ON (the second period) is changed depending on the duration of use. Accordingly, even when the image forming apparatus has been in use for a long period of time and the tungsten filament is more likely to break because of aging, it is possible to cause the halogen cycle to take place by increasing the number of times the heater is turned ON, and to further reinforce the break prevention of the tungsten filament.

The computer program executed on the device and the apparatus (the heater control device or the image forming apparatus) according to the first to the fourth embodiments is provided in a manner incorporated beforehand in a ROM and the like.

The computer program executed on the device and the apparatus according to the first to the fourth embodiments may also be provided as a computer program product in a computer-readable recording medium, such as a compact disk read-only memory (CD-ROM), a flexible disk (FD), a compact disk recordable (CD-R), and a digital versatile disk (DVD), as a file in an installable or an executable format.

Furthermore, the computer program executed on the device and the apparatus according to the first to the fourth embodiments may also be provided by being stored in a computer connected to a network such as Internet, and may be downloaded and provided through the network. The computer program executed on the device and the apparatus according to the first to the fourth embodiments may also be provided or distributed via a network such as Internet.

The computer program executed on the device and the apparatus according to the first to the fourth embodiments has a modular structure including each of the units explained above (the heater control unit). In the actual hardware, by causing a CPU (processor) to read the computer program from the ROM and to execute the computer program, each of the units is loaded onto and is provided on the main memory.

According to the present invention, it is possible to reduce flickering with the minimum power required and to prevent the filament of the heater from breaking.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A heater control device comprising:

storage circuitry configured to store a turn-on pattern of a heater specified in units of a predetermined control cycle including a plurality of half-wavelengths of an alternating-current voltage supplied to the heater so as to prevent flickering;

color temperature detecting circuitry configured to detect a color temperature of light emitted from a filament of the heater; and heater control circuitry configured to perform, while operating in a standby mode in which power supplied to the heater is reduced, cause the heater to be fully turned ON when a first period has elapsed, determine whether the color temperature exceeds a predetermined threshold, when the color temperature does not exceed the threshold, maintain the heater to be fully turned ON until the color temperature exceeds the threshold, and when the color temperature exceeds the threshold, cause the heater to be turned ON in the turn-on pattern, wherein the turn-on pattern specifies that the heater is turned ON at all of the half-wavelengths of the predetermined control cycle such that one of a fully turned ON status and a partly turned ON status is assigned to each of the half-wavelengths.

2. The heater control device according to claim 1, wherein, when the heater control circuitry operates in a normal mode in which the power supplied to the heater is not reduced immediately before operating in the standby mode, after a second period elapses, the heater control circuitry causes the heater to be fully turned ON every time the first period elapses, and turns ON the heater in accordance with the turn-on pattern when the color temperature exceeds the threshold after the heater is fully turned ON.

3. The heater control device according to claim 2, wherein the heater heats a fixing unit used in image formation, and when the heater control circuitry is operating in the normal mode in which the power supplied to the heater is not reduced immediately before operating in the standby mode, after the second period corresponding to number of sheets on which an image is formed in the normal mode immediately before operating in the standby mode elapses, the heater control circuitry causes the heater to be fully turned ON every time the first period elapses, and turns ON the heater in the turn-on pattern when the color temperature exceeds the threshold after the heater is fully turned ON.

4. The heater control device according to claim 1 wherein, while the heater control circuitry operates in the standby mode, the heater control circuitry causes the heater to be fully turned ON every time the first period corresponding to duration of use of the heater control device elapses, and turns ON the heater in the turn-on pattern when the color temperature exceeds the threshold after the heater is fully turned ON.

5. The heater control device according to claim 1, wherein the turn-on pattern specifies a half-wave phase control in which one of the fully turned ON status and the partly turned ON status is assigned to each of the half-wavelengths.

6. The heater control device according to claim 5, wherein, while the heater control circuitry operates in the standby mode, the heater control circuitry turns ON the heater following a pattern for performing a half-wave control in which one of the fully turned ON status and a fully turned OFF status is assigned to each of the half-wavelengths until the first period elapses.

7. An image forming apparatus comprising:

storage circuitry configured to store a turn-on pattern of a heater specified in units of a predetermined control cycle including a plurality of half-wavelengths of an alternating-current voltage supplied to the heater so as to prevent flickering;

color temperature detecting circuitry configured to detect that detects a color temperature of light emitted from a filament of the heater; and heater control circuitry configured to perform, while operating in a standby mode in which power supplied to the heater is reduced, cause the heater to be fully turned ON when a first period has elapsed, determine whether the color temperature exceeds a predetermined threshold, when the color temperature does not exceed the threshold, maintain the heater to be fully turned ON until the color temperature exceeds the threshold, and when the color temperature exceeds the threshold, cause the heater to be turned ON in the turn-on pattern, wherein the turn-on pattern specifies that the heater is turned ON at all of the half-wavelengths of the predetermined control cycle such that one of a fully turned ON status and a partly turned ON status is assigned to each of the half-wavelengths.

8. A heater controlling method executed on a heater control device including a storage circuitry that stores therein a turn-on pattern of a heater specified in units of a predetermined control cycle including a plurality of half-wavelengths of an alternating-current voltage supplied to the heater so as to prevent flickering, the heater controlling method comprising:

detecting a color temperature of light emitted from a filament of the heater; and controlling the heater, by processing circuitry, while operating in a standby mode in which power supplied to the heater is reduced, to cause the heater to be fully turned ON when a first period has elapsed, determine whether the color temperature exceeds a predetermined threshold, when the color temperature does not exceed the threshold, maintain the heater to be fully turned ON until the color temperature exceeds the threshold, and when the color temperature exceeds the threshold, cause the heater to be turned ON in the turn-on pattern, wherein the turn-on pattern specifies that the heater is turned ON at all of the half-wavelengths of the predetermined control cycle such that one of a fully turned ON status and a partly turned ON status is assigned to each of the half-wavelengths.

9. A heater control device comprising:

circuitry configured to:

store a turn-on pattern of a heater specified in units of a predetermined control cycle including a plurality of half-wavelengths of an alternating-current voltage supplied to the heater so as to prevent flickering;

detect a color temperature of light emitted from a filament of the heater; and cause the heater to be fully turned ON at every first period, and then turns ON the heater in the turn-on pattern when the color temperature exceeds a predetermined threshold after the heater is fully turned ON, while operating in a standby mode in which power supplied to the heater is reduced, wherein, when the heater control device operates in a normal mode in which the power supplied to the heater is not reduced immediately before operating in the standby mode, after a second period elapses, the heater control circuitry causes the heater to be fully turned ON every time the first period elapses, and turns ON the heater in accordance with the turn-on pattern when the color temperature exceeds the threshold after the heater is fully turned ON.

10. The heater control device according to claim 9, wherein the heater heats a fixing unit used in image formation, and when the heater control device is operating in the normal mode in which the power supplied to the heater is not reduced immediately before operating in the standby mode, after the second period corresponding to number of sheets on which an image is formed in the normal mode immediately before operating in the standby mode elapses, the heater is caused to be fully turned ON every time the first period elapses, and turns ON the heater in the turn-on pattern when the color temperature exceeds the threshold after the heater is fully turned ON.

11. A heater control device comprising:

circuitry configured to:

store a turn-on pattern of a heater specified in units of a predetermined control cycle including a plurality of half-wavelengths of an alternating-current voltage supplied to the heater so as to prevent flickering;

detect a color temperature of light emitted from a filament of the heater; and cause the heater to be fully turned ON at every first period, and then turns ON the heater in the turn-on pattern when the color temperature exceeds a predetermined threshold after the heater is fully turned ON, while operating in a standby mode in which power supplied to the heater is reduced, wherein, while the heater control device operates in the standby mode, the heater is caused to be fully turned ON every time the first period corresponding to duration of use of the heater control device elapses, and turns ON the heater in the turn-on pattern when the color temperature exceeds the threshold after the heater is fully turned ON.

* * * * *